US005725317A

United States Patent [19]

Gonmori et al.

[11] Patent Number: 5,725,317

[45] Date of Patent: Mar. 10, 1998

[54] HEAD MECHANISM FOR THERMAL PRINTER

[75] Inventors: Yoshikazu Gonmori; Hitoshi Sato, both of Tokyo, Japan

[73] Assignee: CBM Kabushiki Kaisha, Tokyo, Japan

[21] Appl. No.: 752,465

[22] Filed: Nov. 18, 1996

[30] Foreign Application Priority Data

Nov. 17, 1995 [JP] Japan ..... 7-323964

[51] Int. Cl.[6] ..... B41J 11/20

[52] U.S. Cl. ..... 400/58; 347/220; 400/120.16

[58] Field of Search ..... 400/120.16, 120.17, 400/58, 651, 650; 347/197, 198, 220

[56] References Cited

U.S. PATENT DOCUMENTS

| | | | |
|---|---|---|---|
| 5,005,026 | 4/1991 | Sakai | 347/197 |
| 5,146,238 | 9/1992 | Numabe et al. | 347/220 |
| 5,156,467 | 10/1992 | Kitahara et al. | 400/58 |
| 5,212,499 | 5/1993 | Hongo et al. | 347/220 |
| 5,221,932 | 6/1993 | Kurita | 347/220 |
| 5,570,959 | 11/1996 | Moriwaki et al. | 400/56 |

FOREIGN PATENT DOCUMENTS

| | | | |
|---|---|---|---|
| 0134446 | 11/1978 | Japan | 347/220 |
| 0089270 | 3/1992 | Japan | 347/220 |

*Primary Examiner*—Christopher A. Bennett
*Attorney, Agent, or Firm*—Koda and Androlia

[57] ABSTRACT

In a head mechanism according to the present invention, a thermal head 36 is secured to a main body 20 and a platen roller 24 is mounted on the main body 20 in a freely detachable manner. The platen roller 24 is urged by a head spring 40, which is attached to the main body 20, whereby the platen roller 24 is brought into pressured contact with the thermal head 36.

3 Claims, 4 Drawing Sheets

HEAD MECHANISM FOR THERMAL PRINTER

BACKGROUND OF THE INVENTION

1. Field of the Invention

This invention related to a head mechanism peripheral to the thermal head of a thermal printer and, more particularly, to the supporting portions of a platen roller and thermal head.

2. Prior Art

In the head mechanism of a conventional thermal printer, as shown in FIG. 6, a platen roller 2 for paper feed is supported by a bearing 6 secured to a main body 4 such as a metal chassis or plastic frame. A thermal head 8 is secured to a head holder 10 one end of which is pivotably attached to the main body 4 so that the head holder is capable of turning about this end. The head holder 10 is biased from the rear by a head spring 12, whereby the thermal head 8 is brought into pressured contact with the platen roller 2. The head spring 12 is attached to a head spring holder 14 one end of which is pivotably attached to the main body 4 so that the head spring holder is capable of turning about this end. The head spring holder 14 usually is engaged with a lock lever16 in back and hence is fixed against movement.

In this conventional head mechanism comprising the elements mentioned above, paper that has been inserted from a paper course 17 is fed in by rotation of the platen roller 2 and is printed on while being clamped between the thermal head 8 biased by the resiliency of the head spring 12 and the platen roller 2 opposing the thermal head.

In the conventional head mechanism described above, the thermal head 8 is so adapted as to be capable of moving. It is therefore necessary that the thermal head 8 and circuitry for electrically controlling the thermal head be connected by flexible wiring 18, such as a flexible printed wiring board or cable connector, so as not to impede the operation of the thermal head 8. Since the cost of the connecting part is high, the cost of the product is high in this example of the prior art.

Further, when paper that has become jammed in the mechanism is removed or when the surface of the thermal head is cleaned, it is necessary to move the thermal head 8 and pull it away from the platen roller 2. Consequently, the head holder 10 and spring holder 14 which support the thermal head 8 and head spring 12 in a pivotable state must be provided. This not only increases the number of component parts but also complicates the structure.

Furthermore, in the conventional head mechanism, it is necessary to provide space through which the wiring 18 is pulled and space for installing the head holder 10 and head spring holder 14 and for allowing these to move. This makes it difficult to make the apparatus small in size.

SUMMARY OF THE INVENTION

The present invention has been devised in view of the problems of the prior art and its object is to reduce the number of parts, simplify the structure, lower cost, improve productivity and enable a reduction in size.

In the head mechanism for the thermal printer according to the present invention, a thermal head is secured to a main body and a platen roller is mounted in a freely detachable manner. The platen roller is urged by a head spring, which is attached to the main body, whereby the platen roller is brought into pressured contact with the thermal head. Since the platen roller, which does not require an electrical connection, is thus made freely detachable, it is no longer necessary to provide wiring that might impede the mounting and demounting of the platen roller. Further, the platen roller easier to handle than the thermal head and is made attachable, detachable and capable of being forcibly retained through a comparatively simple structure in which the shaft portion thereof is supported by a seat portion having a U-shaped opening and by the head spring which forcibly retains the shaft portion while closing the opening of the seat portion. As a result, in comparison with the example of the prior art in which the thermal head is capable of being moved, it is possible to reduce the number of parts by a wide margin. Size reduction is facilitated as well.

BRIEF DESCRIPTION OF THE DRAWINGS

The invention will be better understood and the objects and features thereof other than those set forth above will become apparent when consideration is given to the following detailed description thereof, which makes reference to the following annexed drawings, wherein.

DETAILED DESCRIPTION OF THE INVENTION

Figure 1:
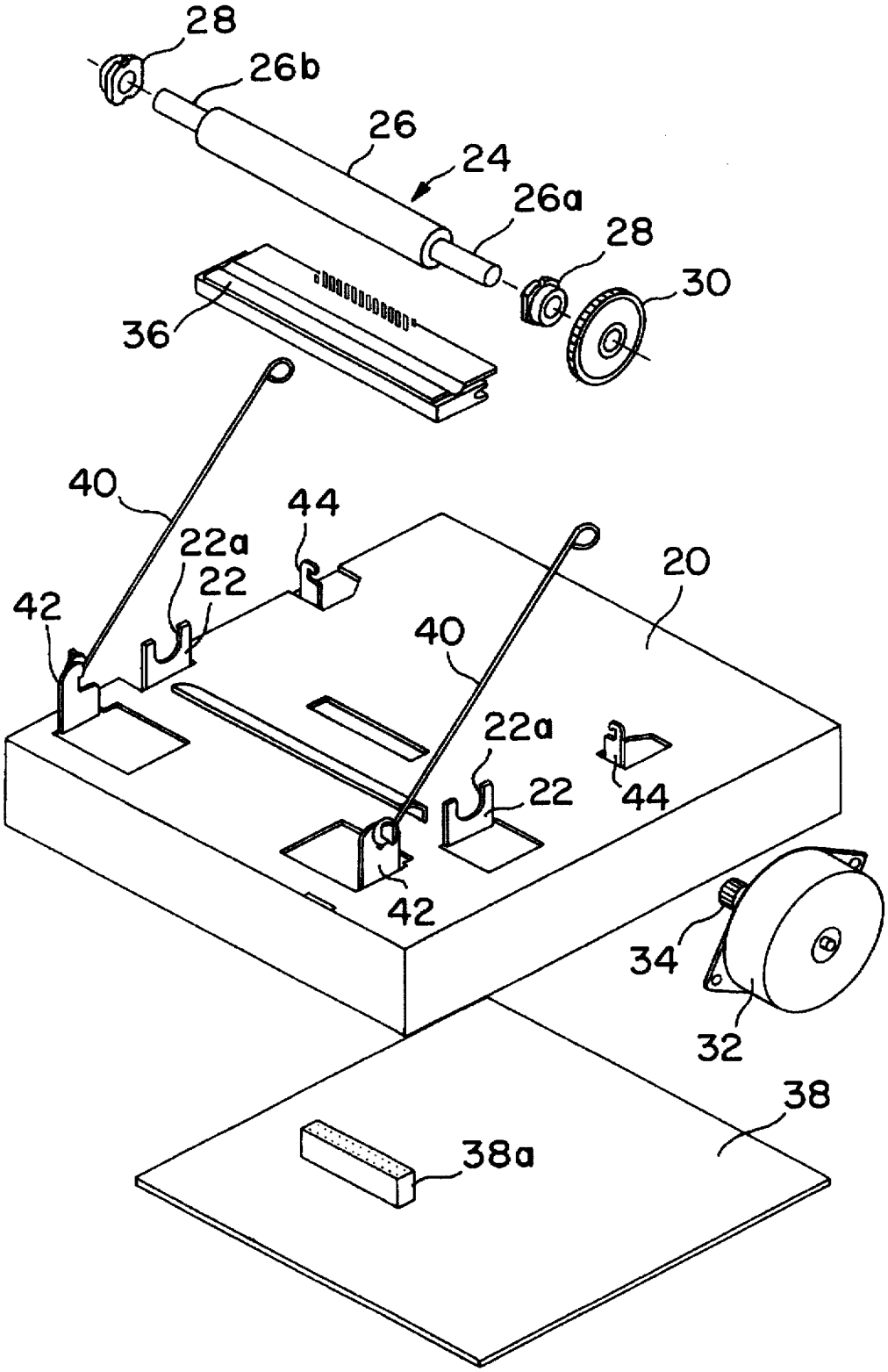
FIG. 1 is an exploded perspective view of a head mechanism according to an embodiment of the present invention.
Figure 2:
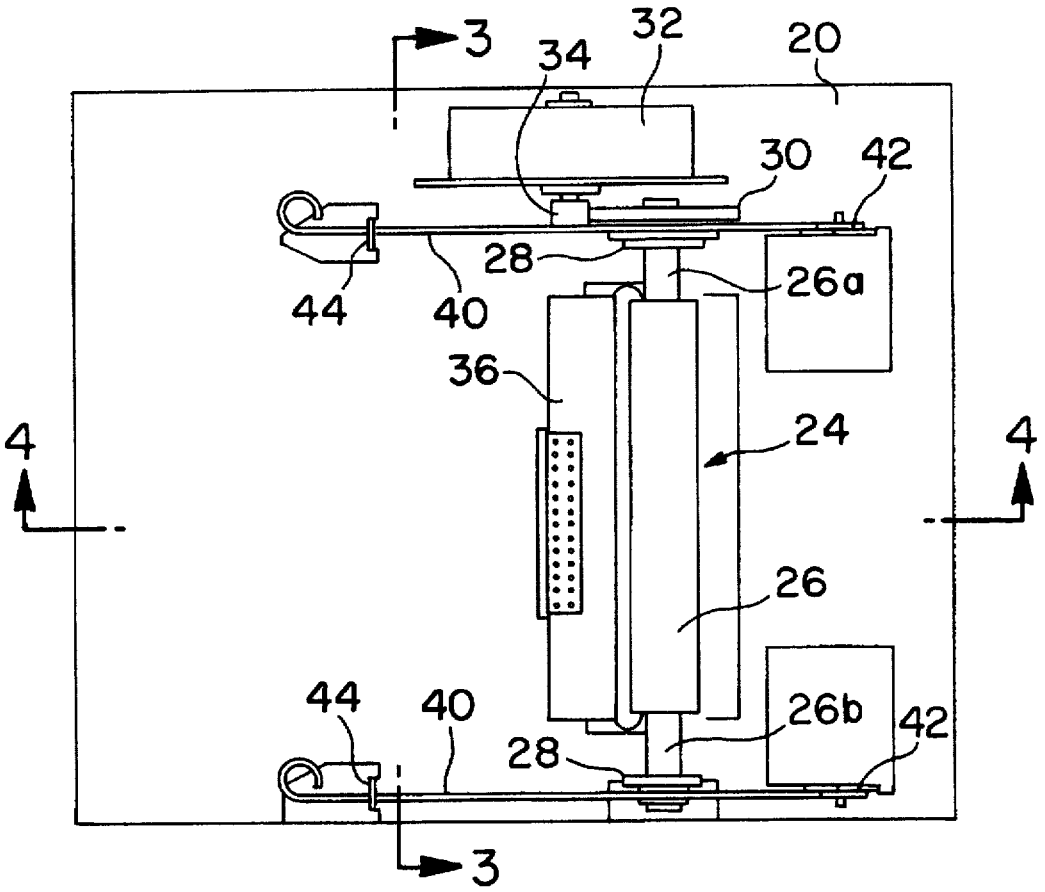
FIG. 2 is a plan view of the head mechanism shown in FIG. 1
Figure 3:
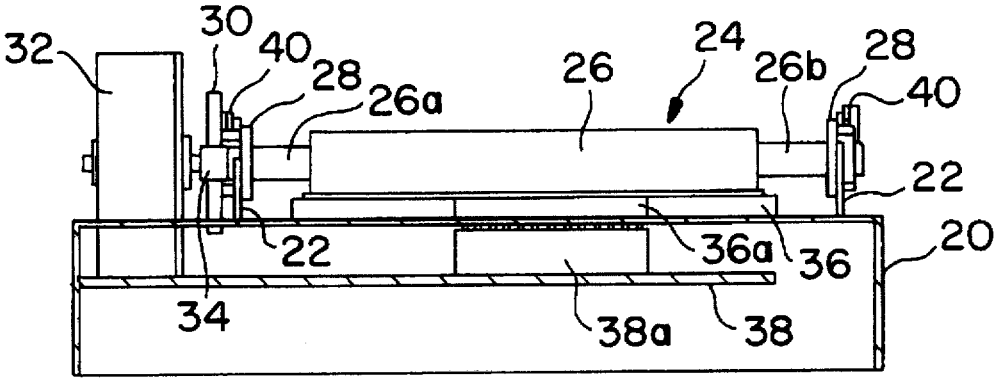
FIG. 3 is a sectional view taken along line A—A of the head mechanism shown in FIG. 1.

Referring to FIG. 1, numeral 20 denotes a main body, such as a metal chassis or plastic frame, of a thermal printer, and numeral 22 denotes a pair of bearings formed as an integral part of or secured to the main body 20. Each bearing 22 is provided with a seat portion **22*a*** having a generally U-shaped opening at its upper end.

Figure 5:
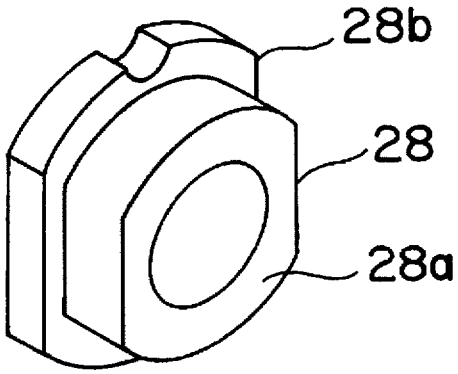
FIG. 5 is a perspective view of a platen bush shown in FIG. 1.
Figure 6:
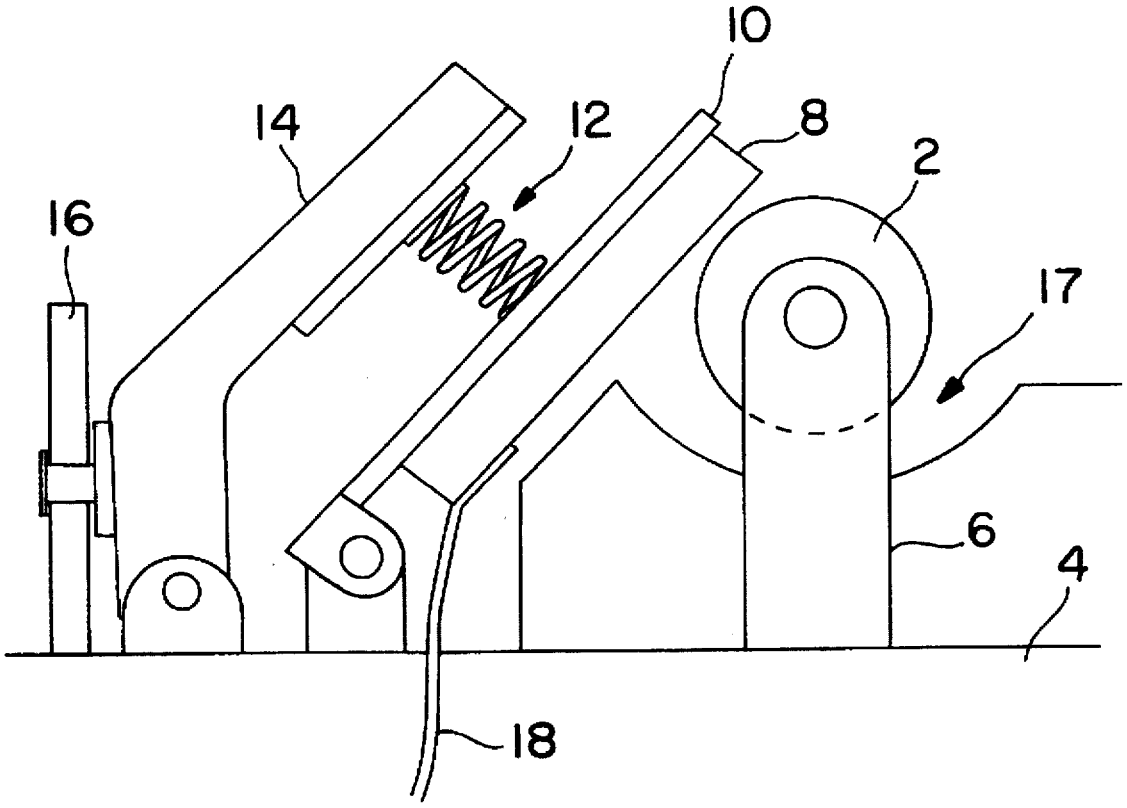
FIG. 6 PRIOR ART
FIG. 6 is a side view showing the head mechanism of a thermal printer according to the prior art.

Numeral 24 denotes a platen roller which, in this embodiment, comprises a roller 26, platen bushes 28 freely rotatably fitted on shaft portions **26*a*, 26*b*, respectively, projecting from both ends of the roller, and a platen gear 30 secured to one shaft portion 26*a* and meshing with a drive gear 34 attached to a motor 32. As shown in FIG. 5, each platen bush 28 comprises a bush body 28*a* having a shape in which part of the outer circumference of a cylinder is cut away in the axial direction so as to conform to the seat portion 22*a* of the bearing 22, and a flange portion 28*b* having a diameter larger than that of the bush body 28*a***.

Numeral 36 denotes a thermal head secured to the surface of the main body 20. The thermal head is connected to the control board 38 by joining a connector **36*a* provided on the bottom side to a connector 38*a* of a control board 38 provided inside the main body 20**.

Numeral 40 denotes a head spring comprising a pair of wire members attached at one end to a pair of anchor portions 42 formed as an integral part of or secured to the main body 20. Further, the wire members are attached at the other end to hook-shaped locking portions 44 formed as an integral part of or secured to the main body 20 and provided at positions opposing the anchor portions 42, with the bearings 22 being located between the anchor portions and the locking portions.

The head mechanism of this embodiment comprising the above-mentioned elements is installed in a state indicated below. First, the connector 36a of the thermal head 36 is joined to the connector 38a and the thermal head 36 is secured to the surface of the main body 20. The platen roller 24 is freely rotatably mounted on the bearings 22 by fitting the platen bush main bodies 28a, which are mounted on respective ones of the shaft portions 26a, 26b at the ends of the platen roller, into the seats 22a of the bearings 22. Furthermore, the surface of the roller 26 of platen roller 24 is positioned so as to touch the thermal head 36 and the design is such that a small clearance is formed between the bush main body 28a of the platen bush 28 and the bottom of the seat portion 22a of bearing 22. At this time the head spring 40 is lowered and its ends are engaged with the locking portions 44. The approximate mid-point of the head spring 40 abuts against the circumferential surface of the bush body 28a of platen bush 28 so that the bush body 28a is pushed into the seat portion 22a. As a result, the platen roller 24 is biased further in the direction of the thermal head 36 and the roller 26 is pressed against the thermal head 36. At this time the positional relationship is such that the platen gear 30 meshes properly with the driver gear 34.

Figure 4:
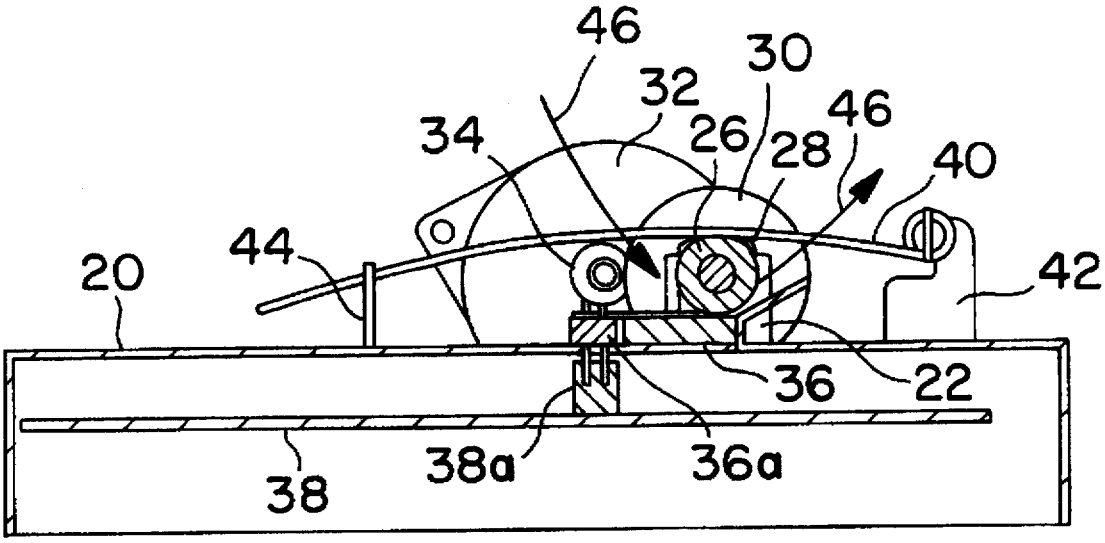
FIG. 4 is a sectional view taken along line B—B of the head mechanism shown in FIG. 1.

In the head mechanism described above, paper is inserted from above and is fed upward to the right between the platen roller 24 and thermal head 36, as indicated by the paper course 46 shown in FIG. 4. When jamming occurs or when the thermal head 36 is cleaned, the ends of the head spring 40 are disengaged from the locking portions 44 then the platen roller 24 is lifted and detached from the bearings 22. As a result, paper sandwiched between the platen roller 24 and thermal head 36 can be removed. Further, since the surface of the thermal head 36 is exposed at this time, it is possible to clean the head.

In accordance with the present invention, the platen roller is capable of being mounted and demounted and the thermal head is fixed. As a result, the thermal head can be connected directly to a control board by a connector. Since a cable or flexible wiring board is unnecessary, such parts can be eliminated.

Further, since the platen roller does not require an electrical connection, it is capable of being detached with ease and can be mounted and demounted through a structure simpler than that of the conventional mechanism, in which the thermal head is rotated and moved. In particular, the mounting/demounting and assembly of the platen roller can be performed entirely from above. The mounting/demounting and assembly operations are easy to comprehend and simpler to carry out in comparison with the manipulation of a locking lever or rotation of a head holder from the side.

Furthermore, the structure is simple, the number of parts can be reduced and space for parts or wiring can be eliminated. This makes it possible to lower cost and reduce the size of the head mechanism.

Moreover, since the platen roller can be detached with ease, it is easy to remove paper and to clean the thermal head. The platen roller therefore is not subjected to excessive force as at cleaning time and there is no longer any danger than the platen roller will be damaged.

We claim:

1. A head mechanism for a thermal printer, comprising:

a main body;

a thermal head secured to said main body;

a platen roller arranged so as to oppose said thermal head and supported on said main body in a freely rotatable and detachable manner; and a head spring attached to said main body for bringing said platen roller into pressured contact with said thermal head, said head spring comprising a pair of wire members attached at one end to anchor portions formed on said main body and attached at an other end to hook-shape locking portions formed on said main body.

2. A head mechanism for a thermal printer, according to claim 1, wherein said platen roller comprises a roller and platen bushes freely rotatably fitted on shaft portions, respectively, projecting from both ends of the roller, and wherein said head spring abuts against the circumferential surface of said platen bush so that said platen bush is pushed into said main body.

3. A head mechanism for a thermal printer, according to claim 1, wherein said thermal head has a connector provided on a bottom side thereof and is connected to a control board by using said connector.

* * * * *